US011102564B2

(12) United States Patent
Woo

(10) Patent No.: US 11,102,564 B2
(45) Date of Patent: Aug. 24, 2021

(54) WIRELESS SOUND DEVICE

(71) Applicant: LG ELECTRONICS INC., Seoul (KR)

(72) Inventor: Seungmin Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/967,540

(22) PCT Filed: Apr. 10, 2018

(86) PCT No.: PCT/KR2018/004163
§ 371 (c)(1),
(2) Date: Aug. 5, 2020

(87) PCT Pub. No.: WO2019/156284
PCT Pub. Date: Aug. 15, 2019

(65) Prior Publication Data

US 2021/0219040 A1 Jul. 15, 2021

(30) Foreign Application Priority Data

Feb. 9, 2018 (KR) ..... 10-2018-0016126

(51) Int. Cl.
*H04R 1/00* (2006.01)
*H04R 1/10* (2006.01)
(Continued)

(52) U.S. Cl.
CPC ..... *H04R 1/1016* (2013.01); *H01Q 1/22* (2013.01); *H01Q 1/273* (2013.01); *H04R 1/06* (2013.01);
(Continued)

(58) Field of Classification Search
CPC .... H04R 1/06; H04R 1/1016; H04R 2420/07; H04R 2499/11; H01Q 1/22; H01Q 1/46; H01Q 1/273
See application file for complete search history.

(56) References Cited

U.S. PATENT DOCUMENTS 11,005,164 B2 * 5/2021 Kim ..... H04R 25/554
2006/0234780 A1 * 10/2006 Ramsden ..... H04M 1/6058 455/569.1
(Continued)

FOREIGN PATENT DOCUMENTS

KR 100953835 4/2010
KR 1020170030366 3/2017
KR 1020170136293 12/2017

OTHER PUBLICATIONS

PCT International Application No. PCT/KR2018/004163, Written Opinion of the International Searching Authority dated Nov. 8, 2018, 15 pages.
Korean Intellectual Property Office Application No. 10-2018-0016126, Notice of Allowance dated Apr. 28, 2021, 5 pages.

*Primary Examiner* — Matthew A Eason
(74) *Attorney, Agent, or Firm* — Lee, Hong, Degerman, Kang & Waimey

(57) ABSTRACT

The present invention relates to a wireless sound device comprising: a housing having a sound hole formed on one side thereof; a sound output unit provided to the housing so as to output sound via the sound hole; a substrate provided to the housing so as to be positioned on the other side of the sound output unit; a battery provided to the housing so as to be positioned on the other side of the substrate, and comprising a pair of electrodes; a wireless communication unit provided to the substrate and carrying out wireless communication by supplying an RF signal; a pair of power terminals for connecting the pair of electrodes with the substrate so as to receive power from the battery; and a feed line
(Continued)

connected to at least one of the pair of electrodes so as to supply the RF signal from the wireless communication unit to the at least one of the pair of electrodes, wherein the electrode connected to the feed line is an antenna for radiating the RF signal.

11 Claims, 4 Drawing Sheets

(51) Int. Cl.
*H04R 1/06* (2006.01)
*H01Q 1/27* (2006.01)
*H01Q 1/22* (2006.01)

(52) U.S. Cl.
CPC ..... *H04R 2420/07* (2013.01); *H04R 2499/11* (2013.01)

(56) References Cited

U.S. PATENT DOCUMENTS

2009/0256766 A1* 10/2009 Bury ..... H01Q 13/10 343/767
2011/0275421 A1* 11/2011 Wong ..... H01Q 1/243 455/572
2014/0323183 A1 10/2014 Klein
2016/0073188 A1* 3/2016 Linden ..... H04R 1/1025 381/309
2016/0205461 A1* 7/2016 Fernandez-Medina ..... H01Q 1/273 381/74
2017/0195466 A1* 7/2017 Chen ..... H04R 1/1041
2017/0245039 A1* 8/2017 Chen ..... H01M 10/36
2020/0288241 A1* 9/2020 Song ..... H04R 5/04
2020/0335856 A1* 10/2020 Kim ..... H04R 1/1091
2021/0089265 A1* 3/2021 van Erven ..... H04B 5/0025

* cited by examiner

WIRELESS SOUND DEVICE

CROSS-REFERENCE TO RELATED APPLICATIONS

This application is the National Stage filing under 35 U.S.C. 371 of International Application No. PCT/KR2018/004163, filed on Apr. 10, 2018, which claims the benefit of earlier filing date and right of priority to Korean Application No. 10-2018-0016126, filed on Feb. 9, 2018, the contents of which are all hereby incorporated by reference herein in their entirety.

TECHNICAL FIELD

The present disclosure relates to a micromini wireless sound device that may be inserted into a user's ears to provide a user with sound by receiving a sound signal from a mobile terminal through wireless communication with the mobile terminal.

BACKGROUND ART

A wireless sound device means a sound device in which an ear phone and a microphone are coupled with each other, receives a sound signal from a mobile terminal and transmits sound information collected through the microphone to the mobile terminal. The wireless sound device may be referred to as an ear set. In the related art, the wireless sound device is based on a cable mode for receiving a sound signal by inserting a terminal into an ear jack of the mobile terminal. However, needs for a wireless sound device of a wireless communication mode are recently increasing in view of mobility and convenience in use.

As a size of the wireless sound device becomes small, a wireless communication unit and a battery are provided in an earbud inserted into a user's ear, whereby a wireless sound device that may directly perform wireless communication with an external terminal without a separate main body has been developed. As the size of the wireless sound device becomes smaller for improvement of portability and wearing, a space for arrangement of components becomes small, whereby effective arrangement of the components is represented as a main issue. Particularly, arrangement of antennas using electromagnetic waves for wireless communication performance is important.

DISCLOSURE

Technical Problem

An object of the present disclosure is to provide a wireless sound device that improves wireless communication performance in a micromini wireless sound device inserted into a user's ear and enhances space utility inside a housing.

Technical Solution

A wireless sound device comprises a housing having a sound hole formed on one side thereof; a sound output unit packaged in housing, outputting sound through the sound hole; a board packaged in the housing so as to be arranged on the other side of the sound output unit; a battery packaged in the housing so as to be arranged on the other side of the board, including a pair of electrodes; a wireless communication unit packaged in the board, performing wireless communication by supplying an RF signal; a pair of power terminals for connecting the pair of electrodes with the board so as to receive a power source from the battery; and an electricity feeding line connected to at least one of the pair of electrodes to supply the RF signal from the wireless communication unit to the at least one of the pair of electrodes, wherein the electrode connected to the electricity feeding line is an antenna for radiating the RF signal.

The pair of electrodes of the battery include a first electrode facing the board and a second electrode headed for the other side of the housing, and the electricity feeding line is connected to the second electrode.

The second electrode may have an area greater than that of the first electrode.

The electricity feeding line may simultaneously be connected to the first electrode and the second electrode.

The first electrode may be an anode and the second electrode may be a cathode, the first electrode may be greater than the second electrode, and a signal transmitted through the second electrode may be a signal of a frequency bandwidth lower than that of a signal transmitted through the first electrode.

The board may include a ground, and may further include a ground line connecting an electrode connected with the electricity feeding line with the ground of the board.

Each of the power terminals may further include an RF choke that prevents the RF signal from passing therethrough.

The electricity feeding line may include a DC blocking for blocking DC signal from passing therethrough.

The board may include a pair of printed circuit boards arranged to overlap each other, and a flexible board connecting the pair of printed circuit boards with each other.

The housing may further include a resonant space at one side to amplify sound output from the sound output unit.

The board may further include a matching circuit for correcting frequencies of the RF signal supplied through the electricity feeding line.

Advantageous Effects

Since the wireless sound device according to the present disclosure may implement an antenna by using a battery, the number of members for the antenna may be reduced, and a space for the antenna may be reduced.

Also, since a distance between a ground of printed circuit boards and the antenna may be longer than that of the related art, short-range wireless communication performance may be enhanced.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BEST MODE FOR CARRYING OUT THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
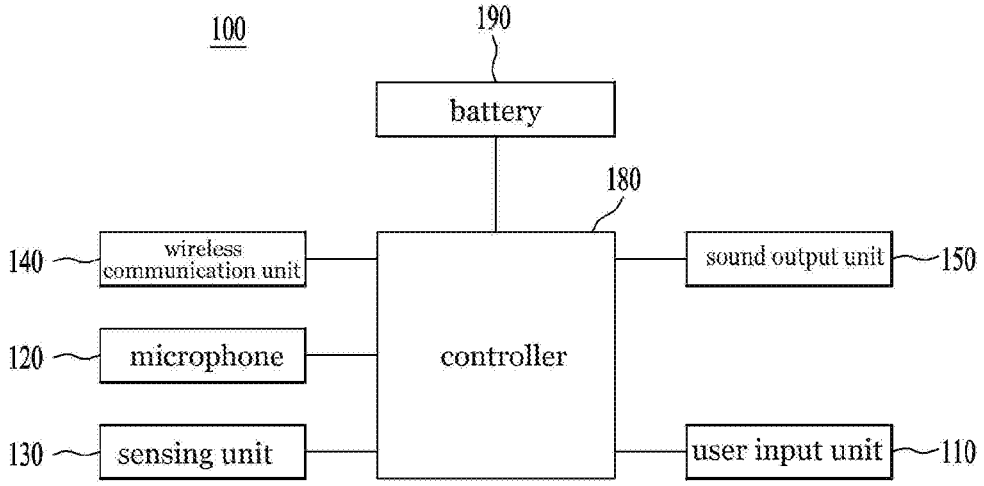
FIG. 1 is a block diagram illustrating a wireless sound device according to the present disclosure.
Figure 2:
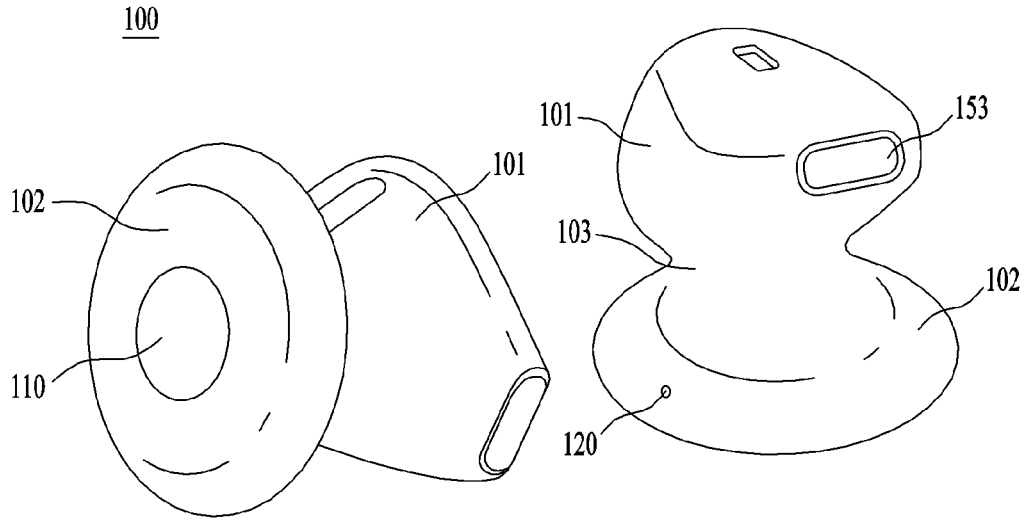
FIG. 2 is a view illustrating a wireless sound device according to the present disclosure.

FIG. 1 is a block diagram illustrating a wireless sound device 100 according to the present disclosure, and FIG. 2 is a view illustrating housings 101, 102 and 103 of a wireless sound device according to the present disclosure. Referring to FIGS. 1 and 2, the wireless sound device 100 of the present disclosure includes housings 101, 102 and 103 forming an external appearance, and a wireless communication unit 140, a microphone 120, a controller 180, a battery 190, a user input unit 110, and a sound output unit 150, which are packaged in the housings.

The wireless sound device 100 of the present disclosure is a portable device that is inserted into a user's ears to output sound as shown in FIG. 2, and is characterized in that its size is small for portability. Particularly in recent years, the wireless sound device may receive a signal in a wireless mode without being connected with a main body and output a sound signal.

A sound hole 153 may be formed at one side 101 of the housing to output sound output from the sound output unit 150, and one side provided with the sound hole 153 is inserted into a user's ear. The other side 102 of the housing is exposed to the outside but an in-ear type wireless sound device 100 of which portion exposed to the outside may be reduced within a minimum range for convenience in use is recently preferred. A portion between one side 101 and the other side 102 of the housing may be recessed and fixed so as not to be well detached from the user's ear when the user inserts one side to his/her ear.

The sound output unit 150 may convert and output audio data received from the wireless communication unit 140 or stored in a memory and sound received from the microphone 120 in a call signal reception mode, a call mode or recording mode, a voice recognition mode, a broadcast reception mode, etc. The sound output unit 150 may output a sound signal related to a call signal reception sound, a message reception sound, etc.

The sound output unit 150 is a converter that coverts an electric signal to sound, and includes main components such as a diaphragm, a voice coil and a magnet.

The diaphragm is a thin vinyl film, and generates sound by changing a flow of the air through its vibration. In order to process all frequency bandwidths from a low bandwidth to a high bandwidth by using one diaphragm, the diaphragm may be coated with a specific material by a method such as steam compression.

The magnet is made of ferrite, aliquot (alloy of Fe, Ni, Al and Co), samarium-cobalt, and neodymium (Nd), and is generally made of a donut shape. The magnet forms a magnetic field, and the voice coil is arranged within the magnetic field formed by the magnet.

The voice coil is a coil attached to the diaphragm, and a current flows to the voice coil in accordance with a sound signal. If the current flowing to the voice coil within the magnetic field formed by the magnet is changed, a force is applied to the voice coil by electromagnetic induction, whereby the diaphragm moves. That is, the current flowing to the voice coil is changed in accordance with the sound signal, and therefore the diaphragm moves, whereby the sound signal is implemented as sound and then the sound is provided to the user.

Since the size of the wireless sound device 100 is small in the present disclosure, the size of the sound output unit 150 packaged in the housings 101, 102 and 103 is gradually reduced and the sound output from the sound output unit 150 may directly be output through the sound hole 153. However, since this structure may deteriorate sound quality of a low sound range, the components packaged in the housings 101, 102 and 103 should be more compactly arranged to make sure of a resonant space 154 in the housings 101, 102 and 103.

The microphone 120 processes an external sound signal to electric audio data. The processed audio data may be used in various ways in accordance with a function performed in the wireless sound device 100 or an application program executed in the wireless sound device 10. Meanwhile, various noise cancelling algorithms for cancelling noise generated in the middle of receiving an external sound signal may be implemented in the microphone 120.

Two or more microphones 120 may be provided to implement noise cancelling, and a user's voice or peripheral noise may be determined based on sound varied depending on the position of the microphone 120.

Also, the microphone 120 may amplify external sound which is recognized and then provide the amplified sound through the sound output unit 150, whereby the microphone 120 may serve as an aid that complements hearing of a user whose hearing is bad.

The user input unit 110 is intended to receive information from a user, and if information is input through the user input unit 110, the controller 180 may control the operation of the wireless sound device 100 to correspond to input information. The user input unit 110 may include a mechanical input means (for example, dome switch, jog wheel, jog witch, etc.) and a touch input means.

The controller 180 controls the wireless communication unit 140 and the sound output unit 150 based on the control signal received from the microphone 120 and the user input unit 110. The controller 180 may amplify sound received from the microphone 120 and output the amplified sound to the sound output unit 150, or may control the sound output unit 150 in accordance with sound data received through the wireless communication unit 140 to provide the user with music or call sound. Also, the controller 180 may control the operation of the wireless sound device 100 based on the signal input from the user input unit 110 or transmit the control signal input from the user input unit 110 to an external terminal through the wireless communication unit 140.

The battery 190 may supply a power source to each electronic component under the control of the controller 180, and may charge an external power source through a charging terminal. The charging terminal may serve as an interface that transmits and receives data.

A secondary battery that may be packaged in a small space and may be charged and discharged may be used as the battery 190. A main example of the battery 190 may include a lithium ion battery. The lithium ion battery includes a pair of electrodes 191 and 192 comprised of a cathode 192 and an anode 191, and an electrolyte arranged between the electrodes 191 and 192. Oxidation-reduction reaction occurs between the electrolyte and the electrodes 192 and 191 and electrons move to supply a power source.

The wireless communication unit 140 is a device connected with the external terminal or a device for performing wireless communication with a server, and may use different communication modes depending on a wireless communication target, distance, data amount and speed. The wireless communication unit 140 may include one or more modules in accordance with each communication mode. A communication mode mainly used for the wireless sound device 100 as the wireless communication module is short-range wireless communication.

Examples the short-range communication mode include Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (Wireless USB).

The controller 180 may sense (or recognize) a terminal, which may perform communication with the wireless sound device 100, near the wireless sound device 100. Moreover, if the sensed terminal is a terminal authenticated to perform communication with the wireless sound device 100 according to the present disclosure, the controller 180 may transmit at least a portion of data processed in the wireless sound device 100 to the terminal through the wireless communication unit 140.

Therefore, a user of the wireless sound device 100 may use data processed by the mobile terminal through the wireless sound device 100. For example, the user may perform a phone call through the wireless sound device 100 if a call is received in the mobile terminal, or may check a message received through the wireless sound device 100 if the message is received in the mobile terminal.

As described above, as the size of the wireless sound device becomes small, an interval between the components becomes narrow. Since an antenna for wireless communication is affected by peripheral components, it is preferable to arrange the antenna at an outside if possible. Also, the antenna should be arranged to avoid a portion that adjoins a user's body, so as to prevent wireless communication performance from being deteriorated in a state that the user wears the wireless sound device. Since one side 101 of the housing is a portion inserted into a user's ear, directly adjoining the user, the antenna may be arranged at the other side 102 of the housing. However, a space for arranging the antenna is small due to a small inner space of the housings 101, 102 and 103, whereby there is a difficulty in design of the components.

In the related art, a pair of printed circuit boards 181*a* and 181*b* are provided by interposing the battery 190 of the wireless sound device 100. In this structure, a distance between a ground arranged in the printed circuit boards 181*a* and 181*b* and the other side of the housings 101, 102 and 103 is short, whereby a problem occurs in that wireless communication performance is deteriorated.

Figure 3:
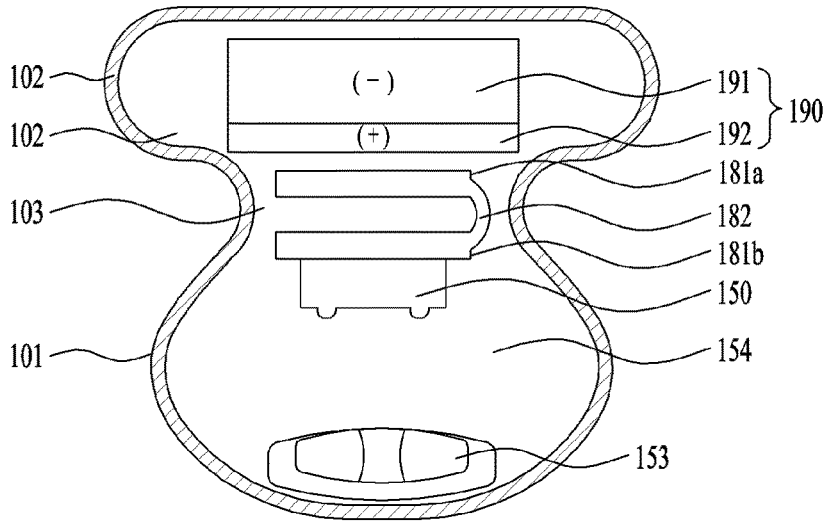
FIG. 3 is a view illustrating an inner configuration of a housing according to one embodiment of a wireless sound device of the present disclosure.

In order to solve this problem, in the present disclosure, the electrodes 191 and 192 of the battery 190 are used as antennas, and arrangement of the battery 190 and a board may be provided unlike the related art, whereby a distance between the antenna and a ground of the board may be spaced apart from each other. FIG. 3 is a sectional view illustrating an inner configuration of housings 101, 102 and 103 according to one embodiment of a wireless sound device 100 of the present disclosure.

A lower side of FIG. 3 is one side 101 of the housing provided with a sound hole 153, and an upper side of FIG. 3 is the other side 102 where the battery 190 is arranged. The board of the present disclosure may include a plurality of printed circuit boards 181*a* and 181*b* and a flexible board 182 connecting the printed circuit boards 181*a* and 181*b* with each other. Although two printed circuit boards 181*a* and 181*b* are shown, additional printed circuit boards may be provided if necessary. The flexible board 182 may additionally be arranged to serve as a signal path connecting the component such as the microphone 120 or the user input unit 110 with the controller 180.

The boards 181*a*, 181*b* and 182 may include a ground. The ground and various components may be connected with one another and grounded to stabilize performance of the components. Particularly, the antenna is affected by connection with the ground and a distance. The ground is a member made of a conductive material, and has a wide area if possible in view of ground performance. Therefore, the ground may be arranged over the total area of the boards 181*a*, 181*b* and 182.

As shown in FIG. 3, the sound output unit 150 may output sound by vibrating the diaphragm in accordance with the sound signal, and the sound may be amplified by the resonant space 154 between the sound hole 153 and the sound output unit 150, whereby sound greater than actual output may be transferred.

The wireless sound device 100 of the present disclosure may include a battery 190 arranged at the other side of the housings 101, 102 and 103 and a pair of electrodes 191 and 192 comprised of a cathode 192 and an anode 191. The pair of electrodes 191 and 192 may have the same size but have different sizes. The electrodes 191 and 192 of a proper size may be used as the antennas in consideration of frequencies to be transmitted and received. For convenience of description, this embodiment will be described based on the embodiment in which the cathode 192 is greater.

Figure 4:
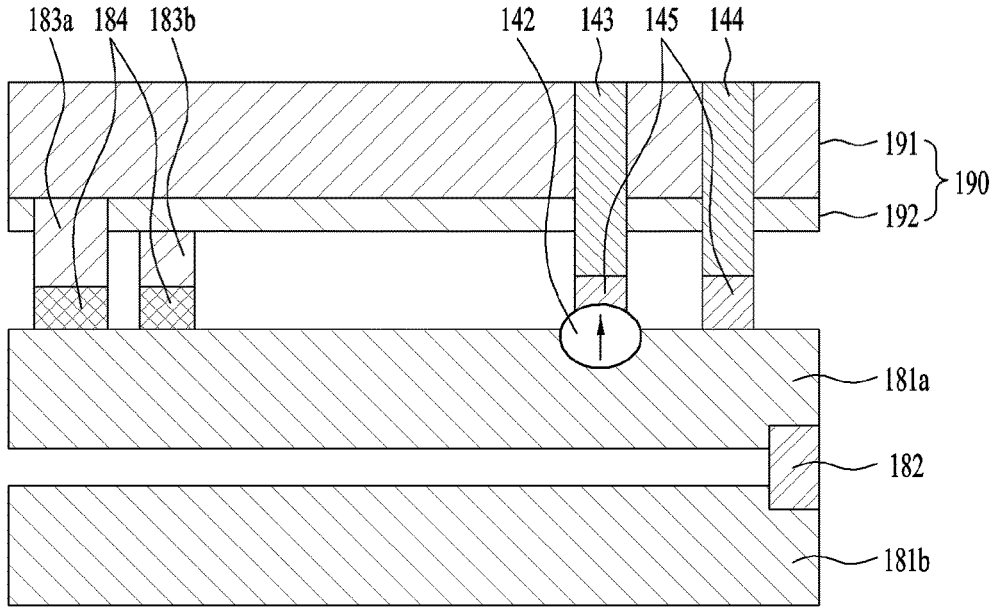
FIG. 4 is a conceptual view illustrating a connection relation between a battery and boards according to one embodiment of a wireless sound device of the present disclosure.

FIG. 4 is a conceptual view illustrating a connection relation between a battery 190 and boards 181*a*, 181*b* and 182 according to one embodiment of a wireless sound device 100 of the present disclosure. The boards 181*a*, 181*b* and 182 include driving chips for controlling various components as the controller 180, and may control the sound output unit 150, the wireless communication unit 140, the user input unit 110, etc. by receiving a power source from the battery 190. The boards 181*a*, 181*b* and 182 may include a pair of power terminals 183*a* and 183*b* respectively connected to the cathode 192 and the anode 191 of the battery 190 to receive the power source from the battery 190.

In the present disclosure, one of the cathode 192 and the anode 191 of the battery 190 is used as an antenna for radiating RF signal applied from the wireless communication unit 140 in the form of electromagnetic wave. The electrodes 191 and 192 of the battery 190 include a conductive material, and the power source supplied from the battery 190 is a DC power source, and a radio signal is RF signal. The electrodes 191 and 192 have difference in their properties and thus may be used as antennas. In addition to the power terminals 183*a* and 183*b*, an electricity feeding line 143 connected with the printed circuit boards 181*a* and 181*b* may further be provided to connect the RF signal to the electrodes 191 and 192 of the battery 190.

In addition to the electricity feeding line 143, a ground line 144 connected with the ground of the printed circuit boards 181*a* and 181*b* may further be provided. A wireless device having a small size, such as the wireless sound device 100 of the present disclosure, has a problem in that impedance is lowered as a distance between the ground of the printed circuit boards 181*a* and 181*b* and the antennas becomes short. The distance between the ground and the antenna may be increased if possible, and the antenna may additionally be grounded through the ground line 144 to forcibly enhance impedance.

In the present disclosure, in a pair of the electrodes 191 and 192 of the battery 190, the electrode 191 or 192 used as an antenna radiator may be arranged at a position spaced apart from the printed circuit boards 181*a* and 181*b* to prevent impedance of the antenna from being lowered, and a ground line may be provided to implement an antenna that stably transmits and receives a signal. The ground line 144, the ground line and the power terminal 183*a* and 183*b* may be implemented using the flexible board 182 or a conductive tape.

The DC power source and the RF signal is a direct current and an alternating current, and an RF choke 184 is provided at the power terminals 183*a* and 183*b* to prevent interference between the direct current and the alternating current from occurring, whereby the RF signal may be prevented from being flown to the board through the power terminals 183*a* and 183*b*. Also, a DC blocking 145 for blocking the DC power source (DC signal) may be provided in the electricity feeding line 143 for applying RF signal, to prevent the direct current from entering there. The DC blocking 145 may be provided even in the ground line 144 as well as the electricity feeding line 143.

The wireless sound device 100 may use a short-range wireless communication technology such as Bluetooth or Wi-Fi for connection with an external terminal in a short distance. Therefore, the wireless communication unit 140 of the present disclosure may be used for Bluetooth or Wi-Fi wireless communication. For example, in case of Bluetooth, a signal of 2.4 GHz may be used, and a size of an antenna is inversely proportional to a wavelength length of a signal to transmit and receive a signal of a corresponding frequency. However, if the antenna is implemented using the electrodes 191 and 192 of the battery 190, it is difficult to finely tune the size of the antenna, whereby resonant frequencies may be adjusted to transmit a signal of a desired frequency bandwidth through a matching circuit.

Figure 5:
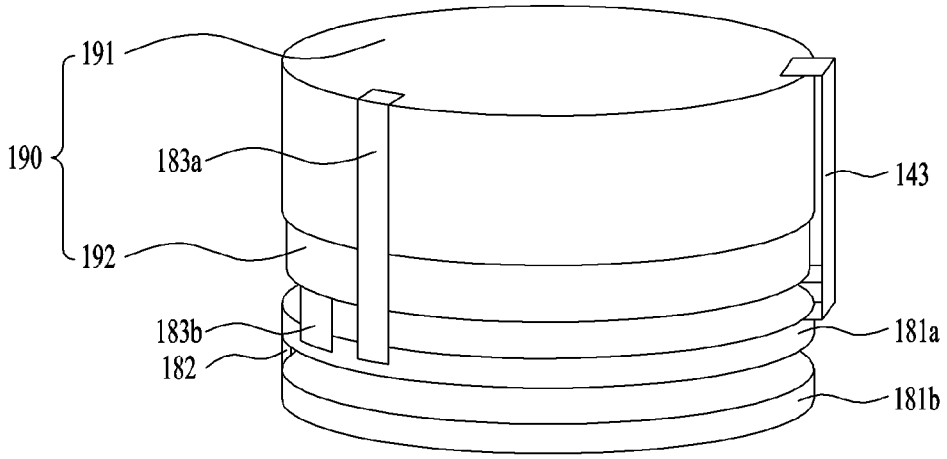
FIG. 5 is a conceptual view illustrating a connection relation between a battery and boards according to another embodiment of a wireless sound device of the present disclosure.

FIG. 5 is a conceptual view illustrating a connection relation between a battery 190 and boards 181*a*, 181*b* and 182 according to another embodiment of a wireless sound device 100 of the present disclosure. In this embodiment, both the cathode 192 and the anode 191 of the battery 190 may be used as antennas.

In the short-range wireless communication technology, with the spread of Intent of things (IoT) technology, usage of the IoT technology is increased, whereby more frequency bandwidths need to be allocated. Therefore, frequency bandwidths have been recently increased. Additional antenna may need to be provided to transmit and receive signals of various frequency bandwidths. In the present disclosure, the electrodes 191 and 192 of the battery 190 may be used.

At this time, the electrode having a smaller size transmits and receives a signal of a high frequency bandwidth and the electrode having a greater size may transmit and receive a signal of a low frequency bandwidth. In this embodiment, since the cathode 192 has a greater size, the cathode 192 may be used as a radiator for a signal of 2.4 GHz, and the anode 191 may be used as a radiator for a signal of 5.8 GHz.

If signals of different frequencies are synthesized and transferred through the electricity feeding line 143 connecting the cathode 192 with the anode 191, each of the electrodes 191 and 192 may radiate only a signal corresponding to the resonant frequency, whereby only one electrode may be used as shown in FIG. 5.

As described above, since the wireless sound device 100 of the present disclosure may implement the antenna by using the battery 190, the number of members for the antenna may be reduced, and it is not required to separately make sure of a space for the antenna. Also, since the distance between the ground of the printed circuit boards 181*a* and 181*b* and the antenna may be longer than that of the related art, short-range wireless communication performance may be enhanced.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A wireless sound device comprising:

a housing having a sound hole formed on one side thereof;

a sound output unit packaged in housing, outputting sound through the sound hole;

a board packaged in the housing so as to be arranged on the other side of the sound output unit;

a battery packaged in the housing so as to be arranged on the other side of the board, including a pair of electrodes;

a wireless communication unit packaged in the board, performing wireless communication by supplying an RF signal;

a pair of power terminals for connecting the pair of electrodes with the board so as to receive a power source from the battery; and an electricity feeding line connected to at least one of the pair of electrodes to supply the RF signal from the wireless communication unit to the at least one of the pair of electrodes, wherein the electrode connected to the electricity feeding line is an antenna for radiating the RF signal.

2. The wireless sound device of claim 1, wherein the pair of electrodes of the battery includes a first electrode facing the board and a second electrode headed for the other side of the housing, and the electricity feeding line is connected to the second electrode.

3. The wireless sound device of claim 2, wherein the second electrode has an area greater than that of the first electrode.

4. The wireless sound device of claim 2, wherein the electricity feeding line is simultaneously connected to the first electrode and the second electrode.

5. The wireless sound device of claim 4, wherein the first electrode is an anode and the second electrode is a cathode, the first electrode is greater than the second electrode, and a signal transmitted through the second electrode is a signal of a frequency bandwidth lower than that of a signal transmitted through the first electrode.

6. The wireless sound device of claim 1, wherein the board includes a ground, and further includes a ground line connecting an electrode connected with the electricity feeding line with the ground of the board.

7. The wireless sound device of claim 1, wherein each of the power terminals further includes an RF choke that prevents the RF signal from passing therethrough.

8. The wireless sound device of claim 1, wherein the electricity feeding line includes a DC blocking for blocking DC signal from passing therethrough.

9. The wireless sound device of claim 1, wherein the board includes a pair of printed circuit boards arranged to overlap each other, and a flexible board connecting the pair of printed circuit boards with each other.

10. The wireless sound device of claim 1, wherein the housing further includes a resonant space at one side to amplify sound output from the sound output unit.

11. The wireless sound device of claim 1, wherein the board further includes a matching circuit for correcting frequencies of the RF signal supplied through the electricity feeding line.

* * * * *